US006628087B2

(12) United States Patent
Roh et al.

(10) Patent No.: US 6,628,087 B2
(45) Date of Patent: Sep. 30, 2003

(54) APPARATUS FOR DRIVING PLASMA DISPLAY PANEL CAPABLE OF INCREASING ENERGY RECOVERY RATE AND METHOD THEREOF

(75) Inventors: Chung-wook Roh, Yongin-si (KR); Jung-pil Park, Cheonan-si (KR); Jea-hyuk Lim, Cheonan-si (KR)

(73) Assignee: Samsung Electronics Co., Ltd., Kyungki-Do (KR)

( * ) Notice: Subject to any disclaimer, the term of this patent is extended or adjusted under 35 U.S.C. 154(b) by 0 days.

(21) Appl. No.: 10/177,768

(22) Filed: Jun. 24, 2002

(65) Prior Publication Data

US 2003/0057851 A1 Mar. 27, 2003

(30) Foreign Application Priority Data

Jun. 22, 2001 (KR) ..... 2001-35761

(51) Int. Cl.[7] ..... G09G 3/10

(52) U.S. Cl. ..... 315/169.3; 345/60; 345/211

(58) Field of Search ..... 315/169.1, 169.3, 315/169.4, 226; 345/60, 76, 77, 78, 79, 211, 212

(56) References Cited

U.S. PATENT DOCUMENTS 5,559,402 A * 9/1996 Corrigan et al. ..... 315/169.3
6,211,867 B1 * 4/2001 Kim ..... 345/211
6,448,950 B1 * 9/2002 Cheng ..... 345/76
6,538,627 B1 * 3/2003 Whang et al. ..... 345/60

* cited by examiner

*Primary Examiner*—Don Wong
*Assistant Examiner*—Jimmy T. Vu
(74) *Attorney, Agent, or Firm*—Sughrue Mion, PLLC

(57) ABSTRACT

An apparatus for driving a plasma display panel (PDP), which is capable of simplifying the structure of a sustain circuit directly affecting the illumination and power consumption of the PDP and increasing an energy recovery rate, and a method thereof are provided. The structure and switching sequence of the sustain circuit are designed so that the transition time to increase the amount of current of an inductor in an energy recovery circuit when charging/discharging the PDP can be minimized. Accordingly, the recovery rate of displacement power can be increased, and EMI can be decreased by not causing switching loss. In addition, the number of circuits required in the apparatus for driving the PDP can be reduced smaller than the number of circuits required in a conventional PDP driver.

17 Claims, 5 Drawing Sheets

APPARATUS FOR DRIVING PLASMA DISPLAY PANEL CAPABLE OF INCREASING ENERGY RECOVERY RATE AND METHOD THEREOF

BACKGROUND OF THE INVENTION

1. Field of the Invention

The present invention relates to a plasma display panel (PDP) driver and a method thereof, and more particularly, to an apparatus for driving a PDP, which is capable of increasing an energy recovery rate and simplifying the structure of a sustain circuit, and a method thereof. The present application is based on Korean Patent Application No. 2001-35761, filed Jun. 22, 2001, which is incorporated herein by reference.

2. Description of the Related Art

In general, a plasma display panel (PDP) is a next-generation flat display which displays text or images with the use of plasma generated by gas discharge, and is comprised of several hundreds of thousands of pixels or several millions or more of pixels arranged in a matrix type. Here, the number of pixels included in a PDP is dependent on the size of the PDP.

FIG. 1 is a diagram illustrating a conventional PDP driver. In the prior art, switching operations for displaying images on a PDP are determined based on an address display separation (ADS) method. Referring to FIG. 1, switches Ys, Yg, Xs, and Xg are sustain switches for applying a high-frequency alternating current (AC) pulsed voltage to a PDP in the sustain period of the PDP. During the sustain period of the PDP, two pairs of switches (Ys, Xg) and (Xs, Yg) alternate in being turned on and off. Other switches Yr, Yf, Xr, and Xf are switches of an energy recovery circuit for controlling power consumption by preventing the voltage and capacitive displacement current of a PDP from rapidly varying. Reference characters LY and LX represent inductors for energy recovery, capacitors C_Yerc and C_Xerc and diodes D_Yr, D_Xf, D_Xr, D_Xf, D_YvsC, D_YGC are necessary to constitute a conventional energy recovery circuit, which has been suggested by Weber, et al. In general, a network including sustain switches, energy recovery switches, and passive devices is referred to as a "sustain" circuit. In an ADS method, the sustain circuit operates only in the sustain period of a PDP. A switch Yp is for separating circuitry operated in the sustain period of the PDP from circuitry operated in other periods (an address period and a reset period) of the PDP in the ADS method. Switches Yrr, Yfr, and Xrr are for applying a ramp-type high voltage to the PDP during the reset period of the PDP and apply a voltage higher than power supply voltage to the PDP during the reset period of the PDP, operating with capacitors Cset and C_Xsink. Switches Ysc and Ysp operate in the address period of the PDP in the ADS method. Specifically, in the address period of the PDP, Ysp is turned on, but Ysc is turned off. On the other hand, in other periods of the PDP, Ysp is turned off, but Ysc is turned on. A scan driver integrated circuit 100 which is comprised of shift register and voltage buffers operates to apply a horizontal synchronization signal of a PDP screen in the address period of the PDP and is short-circuited in other periods. Details of the structure and operation of the conventional PDP driver based on the order of switching operations are set forth in U.S. Pat. No. 4,866,349.

In the conventional PDP driver, the conventional sustain circuit, which directly affects the illumination and power consumption of a PDP, requires many switch devices and passive devices. In addition, since the conventional sustain circuit takes advantage of a pure LC resonance phenomenon when charging and discharging a PDP, the PDP is rapidly charged or discharged all the time in a case where parasitic resistance of the PDP exists, and switching loss occurs at a MOS field effect transistor (MOSFET) switch. Accordingly, the power efficiency of the sustain circuit decreases, and the EMI of the sustain circuit increases. In addition, capacitive displacement current increases, and then displacement power and device stress also increase. Thus, illumination efficiency decreases.

SUMMARY OF THE INVENTION

To solve the above-described problems, it is an object of the present invention to provide a plasma display panel (PDP) driver, which has a decreased number of devices and is capable of increasing an energy recovery rate for reducing displacement power, and a method thereof.

Accordingly, to achieve the above object, there is provided an apparatus for driving a plasma panel display (PDP), which is capable of improving an energy recovery rate, the apparatus for driving a PDP comprising an energy recovery circuit and a plurality of switches, wherein the energy recovery circuit comprises a switch for applying a power source during a gas discharging period of the PDP; capacitors connected in series between the power source and ground; and an inductor connected between a point in a path connecting the two capacitors and an output terminal of the switch, whereby a switching sequence is set for controlling turning on/off of the switch and the plurality of switches so that the maximum instantaneous current of the inductor can flow into the PDP at a transition time between charging of the PDP and discharging of the PDP.

To achieve the above object, there is provided a method for driving a PDP, which has an energy recovery circuit including an inductor for recovering power when charging/discharging the PDP in the sustain period and exhibits a switching sequence of repeatedly performing a reset period, an address period, and a sustain period, the method for driving a PDP controls the switching sequence so that the maximum instantaneous current of the inductor of the energy recovery circuit can flow into the PDP at a transition time between charging of the PDP and discharging of the PDP in the sustain period.

BRIEF DESCRIPTION OF THE DRAWINGS

The above objects and advantages of the present invention will become more apparent by describing in detail preferred embodiments thereof with reference to the attached drawings in which.

DETAILED DESCRIPTION OF THE INVENTION

Figure 1:
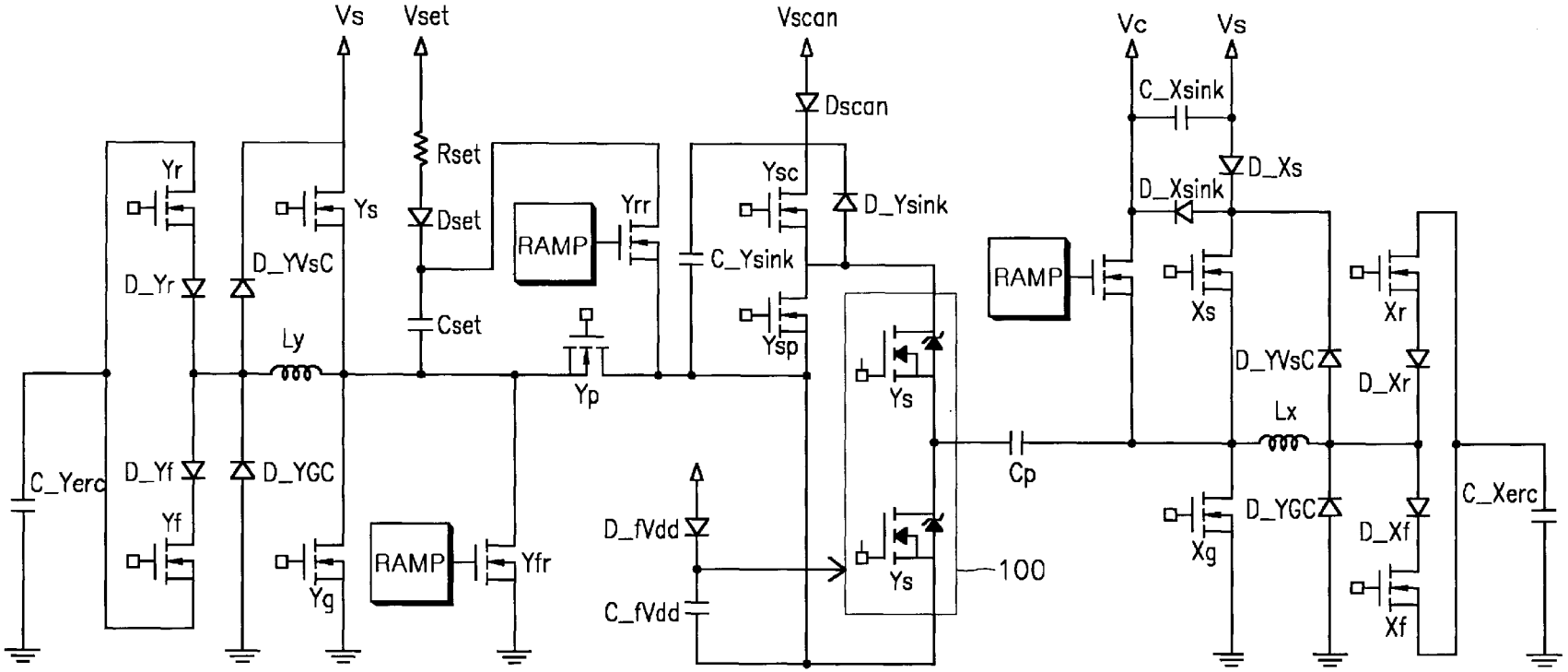
FIG. 1 (PRIOR ART)
FIG. 1 is a diagram illustrating a conventional plasma display panel (PDP) driver device.
Figure 2:
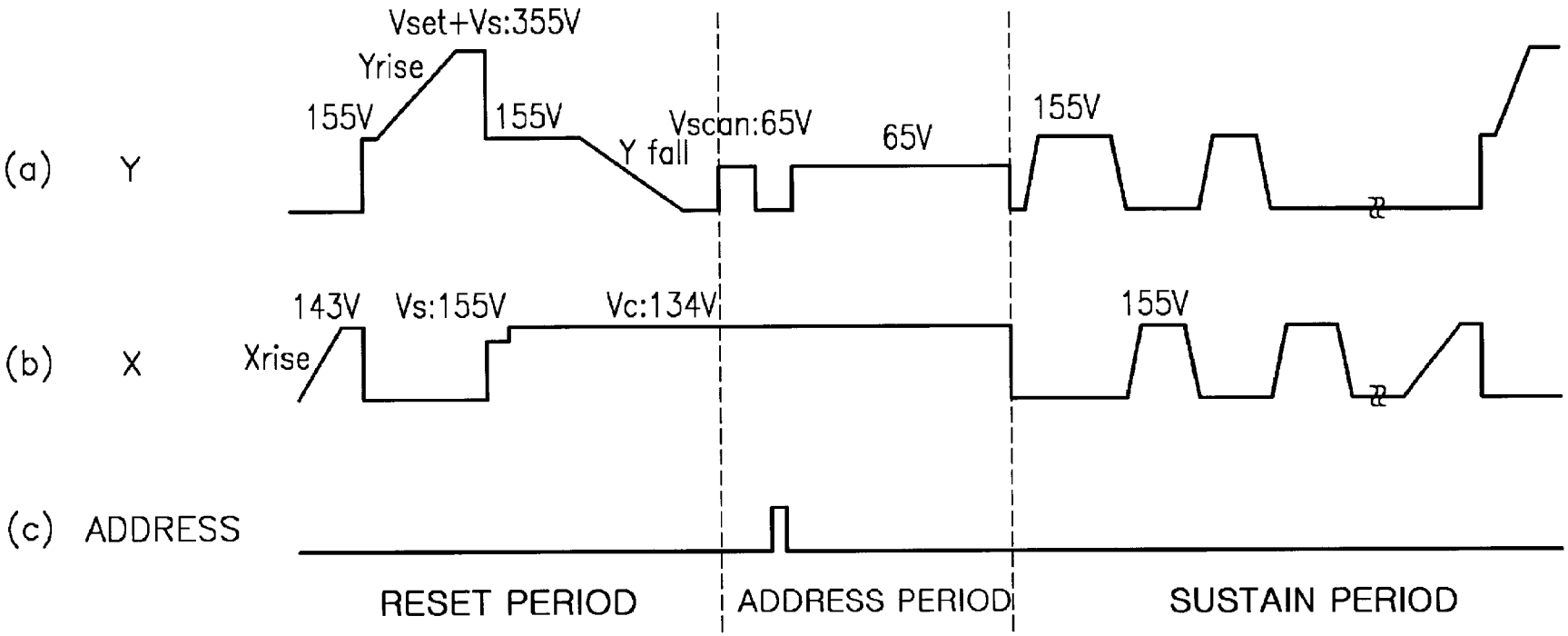
FIG. 2 (PRIOR ART)
FIG. 2 is a waveform diagram illustrating the operation of the apparatus for driving a PDP of FIG. 1.
Figure 3:
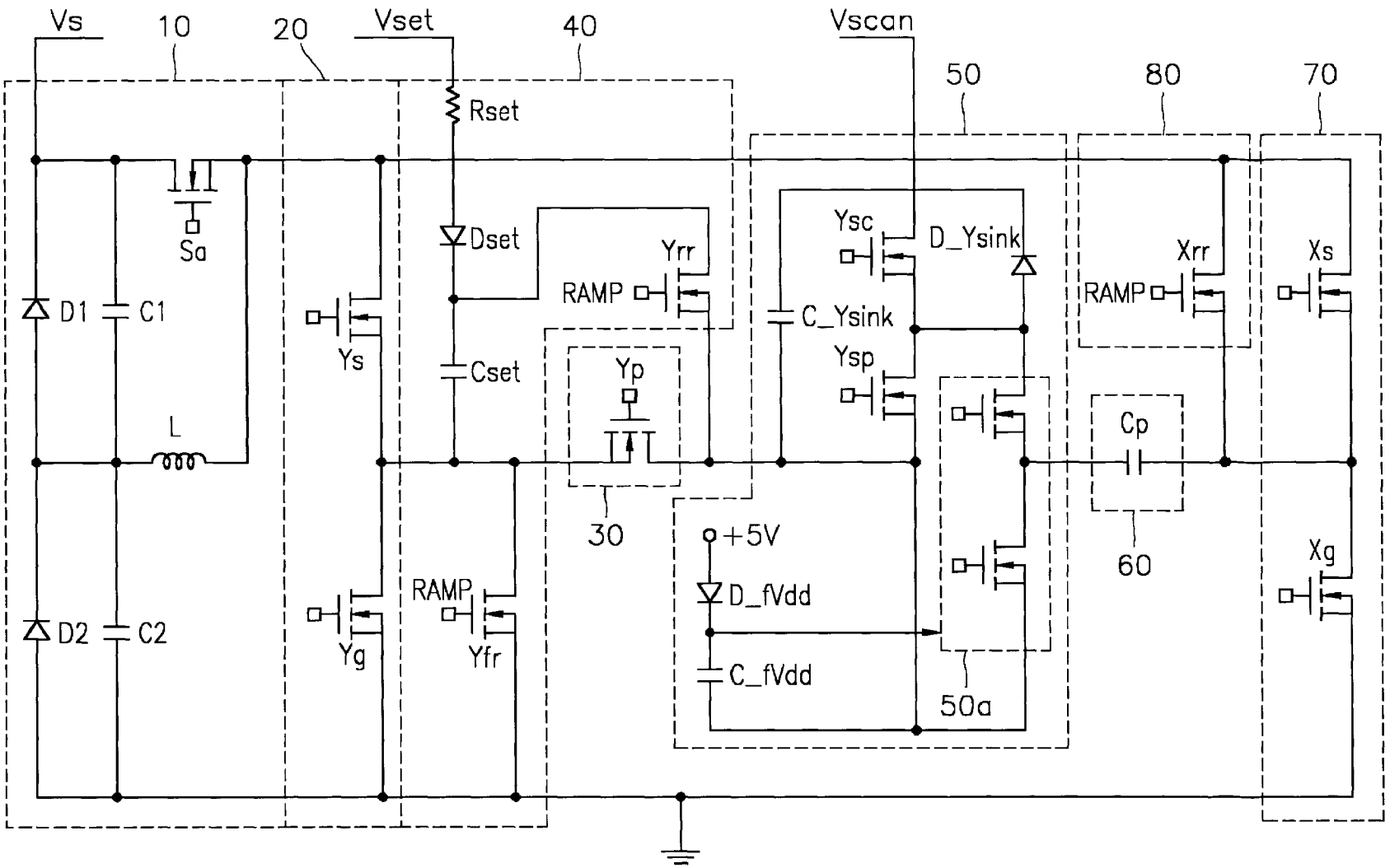
FIG. 3 is a diagram illustrating an apparatus for driving a PDP device according to a first embodiment of the present invention, which is capable of increasing an energy recovery rate.
Figure 4:
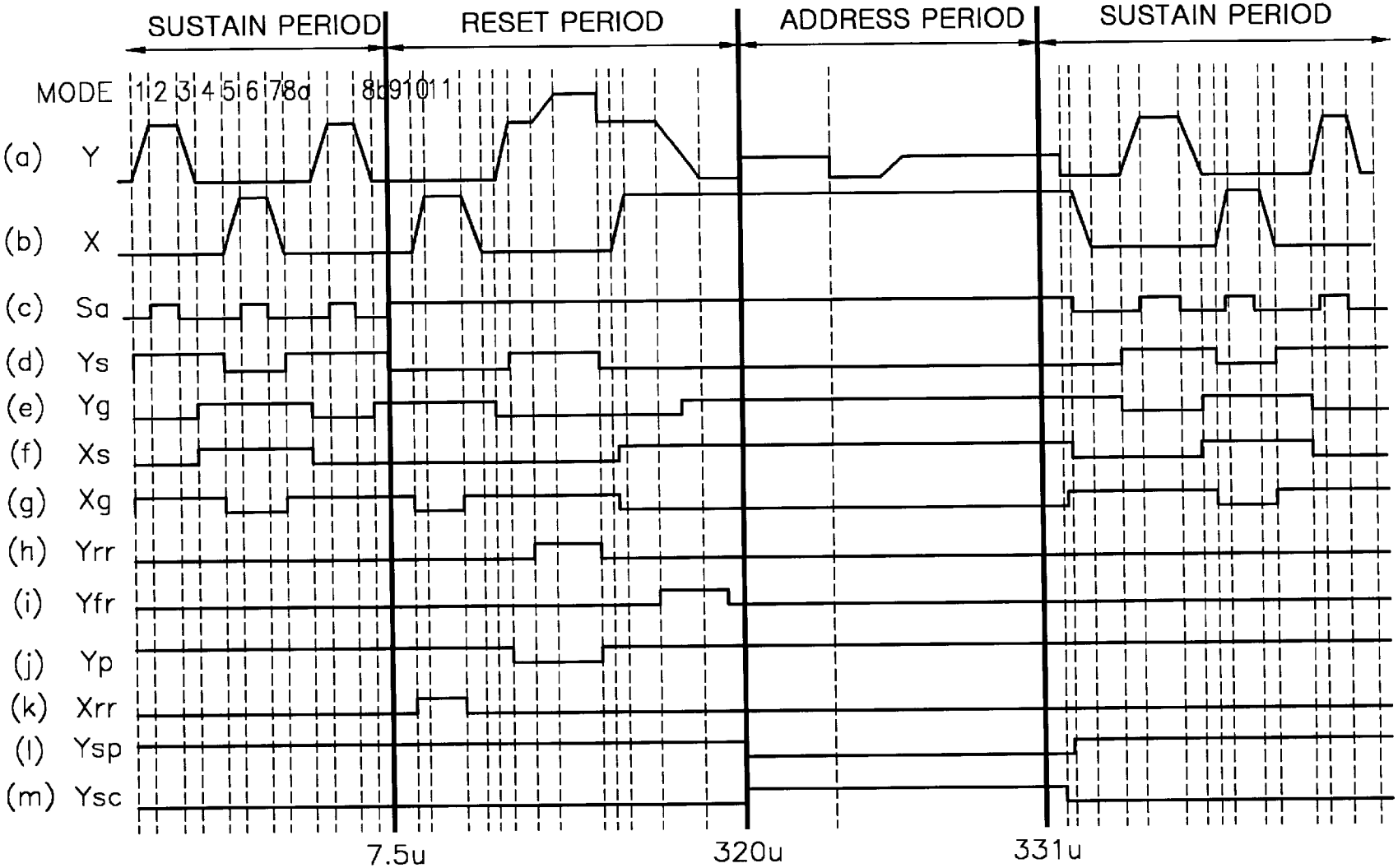
FIG. 4 is a waveform diagram illustrating the sequence of switching operations of an apparatus for driving a PDP according to the present invention.

As shown in FIG. 3, a plasma display panel (PDP) driver according to a first embodiment of the present invention, which is capable of increasing an energy recovery rate, includes an energy recovery unit 10, a Y-electrode sustain switching circuit 20, a separation circuit 30, a Y-electrode ramp-waveform generator 40, a scan pulse generator 50, a plasma display panel 60 (Cp), an X-electrode sustain switching circuit 70, and an X-electrode ramp-waveform generator 80.

The energy recovery unit 10 includes a switch Sa for applying an external voltage source Vs during the emission period of the PDP 60, capacitors C1 and C2, which are connected in series between the external voltage source Vs and ground, an inductor L, which is connected between a point in the path connecting the two capacitors C1 and C2 and an output port of the switch Sa, and diodes D1 and D2, which are arranged with the capacitors C1 and C2, respectively, in parallel.

The Y-electrode sustain switching circuit 20 includes switches Ys and Yg for applying a high-frequency AC-pulsed voltage to the PDP (Cp) during the sustain period of the PDP 60. The X-electrode sustain switching circuit 70 includes switches Xs and Xg for applying a high-frequency AC-pulsed voltage to the PDP (Cp) during the sustain period of the PDP 60.

The separation circuit 30 is a switch for separating circuitry operated in the sustain period of the PDP 60 from circuitry operated in other periods (an address period and a reset period) of the PDP 60.

The Y-electrode ramp waveform generator 40 and the X-electrode ramp waveform generator 80 are for generating a ramp-type high voltage at the PDP 60 during the reset period of the PDP 60.

In the scan pulse generator 50, a scan driver integrated circuit (IC) 50*a*, which is comprised of shift register and voltage buffers, operates to apply a horizontal synchronization signal to a PDP screen in the address period of the PDP 60 and is short-circuited in other periods of the PDP 60.

Each of the switches included in such circuit may be comprised of a MOSFET.

A method for driving a PDP according to the present invention is characterized by the fact that displacement power is almost maintained at 0 by designing a sustain circuit to have a structure and a switching sequence, which are capable of minimizing the time taken to increase the current of the inductor L in the energy recovery unit 10 during charging/discharging of the PDP 60. Accordingly, in the present invention, a sustain circuit is designed so that the maximum instantaneous current of the inductor L can flow into the PDP 60 at a transition period between charging of the PDP 60 and discharging of the PDP 60.

Switching operations for driving the PDP 60 sequentially and repeatedly perform a reset period, an address period, and a sustain period. Hereinafter, the sequence of switching operations in the sustain period for increasing an energy recovery rate, as desired in the present invention, will be described in detail for each mode constituting the sustain period.

1) Mode 1 (a charging mode in the sustain period; V_Y; 0→Vs, V_X=0, time interval=Tr)

In the mode 1, the switches Ys, Xg, and Ysp are turned on, other switches are turned off, and the scan driver IC 50*a* of the scan pulse generator 50 is short-circuited. Accordingly, the X-electrode voltage V_X of the PDP 60 is maintained at a ground voltage, and the Y-electrode voltage V_Y of the PDP 60 reaches Vs. In other words, current flows along a path connecting C2, L, Ys, Yp, Ysp, Cp, and Xg in the mode 1. Thus the PDP 60 (Cp) begins to be charged by the maximum instantaneous current $I_{L,PK}$ flowing into the inductor L, and the Y-electrode voltage V_Y of the PDP 60 is increased. When the Y-electrode voltage V_Y of the PDP 60 reaches Vs, charging of the PDP 60 (Cp) is completed. During this PDP charging period, the voltage of the PDP 60 is gradually increased with a predetermined gradient by the maximum instantaneous current of the inductor L. In the sustain circuit of the present invention, unlike in the conventional sustain circuit, the Y-electrode voltage of the PDP 60 (Cp) can be prevented from rapidly varying, irrespective of the existence of parasitic resistance. The time interval Tr of the mode 1 is designed to be about 300 ns–500 ns.

2) Mode 2 (a gas discharging mode in the sustain period; V_Y=Vs, V_X=0, time interval=Tsus)

In the mode 2, the Y-electrode voltage V_Y of the PDP 60 becomes Vs, an inner body diode of the switch Sa is turned on. If the switch Sa is turned on, it performs a zero voltage switching operation, and thus there is no switching loss. The illumination state of the PDP 60 is sustained by current flowing along a path connecting Sa, Ys, Cp, and Xg. The current IL of the inductor L decreases linearly along a path connecting Cl, L, and Sa. The current IL of the inductor L varies from $+I_{L,PK}$ to $-I_{L,PK}$. When the switch Sa is turned off, the mode 2 is over. The time interval Tsus of the mode 2 is designed to be about 1.6 μs–2.0 μs and is the same as the period of time, for which the switch Sa is turned on.

3) Mode 3 (a discharging mode in the sustain period; V_Y=Vs→0, V_X=0, time interval=Tf)

In the mode 3, the switch Sa is turned off. The PDP 60 begins to be discharged along the path connecting Xg, Cp, Ysp, Yp, Ys, L, and C2. Thus, the PDP 60 begins to be discharged by the maximum instantaneous current $-I_{L,PK}$ flowing into the inductor L. The Y-electrode voltage V_Y of the PDP 60 decreases. When the Y-electrode voltage V_Y of the PDP 60 reaches 0, discharging of the PDP 60 is completed. During this PDP discharging period, the voltage of the PDP 60 is gradually decreased by the instantaneous current of the inductor L with a predetermined gradient. Even when parasitic voltage exists, the Y-electrode voltage V_Y of the PDP 60 does not vary considerably.

The time interval Tf of the mode 3 is designed to be about 300–500 ns and is the same as Tr.

4) Mode 4 (a GND mode, in the sustain period; V_Y=0, V_X=0, time interval=Tgnd)

In the mode 4, the Y-electrode voltage V_Y of the PDP 60 becomes 0, and the switch Yg and an inner body diode in the switch Xg are turned on. In the mode 4, if the switches Yg and Xg are turned on, the switches Yg and Xg perform a zero-voltage switching operation, and thus there is no switching loss. The voltage of the PDP 60 is maintained at 0 through a path connecting Xg, Cp, and Yg. The current $I_L$ of the inductor L increases linearly along a path connecting C2, L, and (Ys, Yg, Xs, Xg) and varies from $-I_{L,PK}$ to $+I_{L,PK}$. When the switch Ys and Xg are turned off, the mode 4 is over. The time interval Tgnd of the mode 4 is designed to be 300 ns–500 ns.

5) Mode 5 (a charging mode in the sustain period; V_Y=0, V_X=0→Vs, time interval=Tr)

In the mode 5, the switches Xs, Yg, Yp, and Ysp are turned on, and other switches are turned off. The scan driver IC 50*a* is short-circuited. The PDP 60 (Cp) begins to be charged by the maximum instantaneous current $I_{L,PK}$ of the inductor L, while current flows along a path connecting C2, L, Xs, Cp, Ysp, Yp, and Yg. The X-electrode voltage of the PDP 60 increases. When the X-electrode voltage of the PDP 60 reaches Vs, charging of the PDP 60 is completed.

6) Mode 6 (a gas discharging mode in the sustain period; V_Y=0, V_X=Vs, time interval=Tsus)

In the mode 6, the X-electrode voltage of the PDP 60 becomes Vs, the inner body diode in the switch Sa is turned on. At the same time, if the switch Sa is turned on, the switch Sa performs a zero-voltage switching operation, and thus there is no switching loss. The PDP 60 maintains its illumination state due to current flowing along a path connecting Sa, Xs, Cp, and Yg. The current IL of the inductor L decreases linearly along a path connecting C1, L, and Sa and varies from $+I_{L,PK}$ to $-I_{L,PK}$. When the switch Sa is turned off, the mode 6 is over.

7) Mode 7 (a discharging mode in the sustain period; V_Y=0, V_X=VS→0, time interval=Tf)

In the mode 7, the switch Sa is turned off, and the PDP 60 begins to be discharged by the maximum instantaneous current from $-I_{L,PK}$ flowing into the inductor L, while current flows along a path connecting Yg, Cp, Ysp, Yp, Xs, L, and C2. The X-electrode voltage of the PDP 60 decreases. When the X-electrode voltage of the PDP 60 reaches 0, discharging of the PDP 60 is completed.

8) Mode 8-a (a GND mode, in the sustain period; V_Y=0, V_X=0, time interval=Tgnd)

In the mode 8-a, the Y-electrode voltage V_Y of the PDP 60 becomes 0, the switch Yg and the inner body diode in the switch Xg are turned on. In the mode 8-a, if the switches Yg and Xg are turned on, they perform perform a zero-voltage switching operation, and thus there is no switching loss. The PDP 60 maintains its zero-voltage state through a path connecting Xg, Cp, and Yg. The current IL of the inductor L increases linearly along a path connecting C2, L, and (Ys, Yg, Xs, Xg) and varies from $-I_{L,PK}$ to $+I_{L,PK}$.

The displacement current of the sustain period can be interpreted as follows. Specifically, voltages Vc1 and Vc2 applied to the capacitors C1 and C2 can be expressed by the following equations.

$$Vc1 = \frac{Tgnd}{Tsus + Tgnd} \times Vs \tag{1}$$

$$Vc2 = \frac{Tsus}{Tsus + Tgnd} \times Vs \tag{2}$$

The maximum instantaneous current $I_{L,PK}$ of the inductor L can be expressed by the following equation.

$$I_{L,PK} = \frac{C_P V_S}{T_r} \tag{3}$$

In most PDPs, the time interval Tsus is greater than the time interval Tgnd. Accordingly, the voltage Vc2 is close to the external voltage source Vs, and the voltage Vc1 reaches 0. This means that the amount of the leakage current of the inductor L is very small in a transition period except the sustain period. In addition, the amount of the maximum instantaneous current $I_{L,PK}$ of the inductor L in the present invention is always smaller than the maximum instantaneous current $$I^*_{L,PK}\left(I^*_{L,PK} = \frac{\pi}{2} \times \frac{C_P V_S}{T_r}\right)$$

of an inductor in the prior art, and accordingly, displacement power decreases.

In the sustain period, for which a PDP is illuminated, high-frequency voltage pulses of the PDP are generated by repeatedly performing the operations of the modes 1 through 8-a. The number of pulses may vary from 2 to 128 based on a sub-field of the ADS method. In a transition period after the sustain period is over, a mode 8-b replaces the mode 8-a.

9) Mode 8-b (a transition mode between the sustain period and the reset period; the voltage of the PDP 60 is maintained at 0; V_Y=0, V_X=0, time interval+Tgnd_SR)

In the mode 8-b, the Y-electrode voltage of the PDP 60 reaches 0, and the inner body diodes of the switches Yg and Xg are turned on. The switch Yg is turned on, and the switch Ys is turned off. At the same time, the switch Yg is turned on, and the switch Ys is turned off. The current $I_L$ of the inductor L reaches 0. The time taken for these operations to be performed is about half of the time interval Tgnd. Next, the inductor current $I_L$ reaches 0, and the voltage of the PDP 60 is maintained at 0.

10) Mode 9 (a transition mode between the sustain period and the reset period; the voltage of the PDP 60 is maintained at 0; V_Y=0, V_X=0, time interval=T9)

In the mode 9, the switch Sa is turned on, but the switch Xg is turned off. The ON-state of the switch Sa is continuously maintained in the entire period including the reset period and the address period after the mode 9. In the mode 9, the voltage of the PDP 60 is always maintained at 0. In addition, the current $I_L$ of the inductor L increases, and the voltage Vc1 decreases, as shown in the following equations.

$$I_L(t) = Vc1\sqrt{\frac{C_1}{L}} \times \sin\frac{t}{\sqrt{LC_1}} \tag{4}$$

$$Vc1(t) = Vc1 \times \cos\frac{t}{\sqrt{LC_1}} \tag{5}$$

When a X-ramp switch Xrr is turned on, the mode 9 is over.

11) Mode 10 (a transition mode between the sustain period and the reset period; the voltage of the PDP 60 gradually increases; V_Y=0, V_X increases from 0, time interval=T10)

Actually, the mode 10 belongs to the reset period of the PDP 60. In the mode 10, the X-ramp switch Xrr is turned on, and the X-electrode voltage of the PDP 60 gradually increases. The current $I_L$ of the inductor L and the voltage Vc1 are the same as those in the mode 9. When the inductor current $I_L$ reaches its maximum value, in other words, when the voltage Vc1 reaches 0, the mode 10 is completed. The time intervals T9 and T10 can be expressed by the following equation.

$$T9 + T10 = \frac{\pi}{2} \times \sqrt{LC_1} \tag{6}$$

The values of the capacitors C1 and C2 in the sustain circuit of the present invention are set such that the maximum value of the inductor current $I_L$ is no greater than the maximum instantaneous current of the inductor L in the sustain period.

12) Mode 11 (a transition mode between the sustain period and the reset period; the inductor current $I_L$ decreases)

When the voltage Vc1 reaches 0, the diode D1 is turned on, and the inductor current $I_L$ decreases. When the inductor current $I_L$ reaches 0, the mode 11 is completed. Next, the voltage Vc1 reaches 0, and the voltage Vc2 becomes the same as Vs.

Details of the reset period and the address period after the mode 11 are the same as those in a conventional ADS driving method, and thus their description will be omitted. The address period continues until the first pulse (V_Y=Vs, V_X=0) of the sustain period is over. Hereinafter, the operations of the sustain circuit of the present invention after the first pulse of the sustain period will be described in detail.

13) Mode 12 (the sustain period; the voltage of the PDP is maintained at 0; the inductor current $I_L$ increases from 0 to $I_{L,PK}$)

After the first pulse of the sustain period is over, the switch Sa is turned off, and the switches Ys and Yg are turned on. The inductor current $I_L$ and the voltage Vc2 applied along the path connecting C2, L, Ys, and Yg can be expressed by the following equations.

$$I_L(t) = Vs\sqrt{\frac{C_2}{L}} \times \sin\frac{t}{\sqrt{LC_2}} \tag{7}$$

$$Vc2(t) = Vs \times \cos\frac{t}{\sqrt{LC_2}} \tag{8}$$

If the switch Yg is turned off when IL (t) reaches $I_{L,PK}$, the mode 12 is completed, and the operations of the mode 1 are repeated. The time interval of the mode 12 can be expressed by the following equation:

$$T12 = \sqrt{LC_2}\ \sin^{-1}\left(\frac{C_p}{T_r} \times \sqrt{\frac{L}{C_2}}\right) \tag{9}$$

If the time interval T12 of the mode 12 is set to satisfy the above equation when actually driving the PDP 60, the zero-voltage switching of all switches can be desirably ensured in the sustain period. Thus, there is no switching loss, and EMI decreases.

Various parameters of the apparatus for driving a PDP of the present invention, in which displacement power is included, are compared to those of a conventional PDP driver, and the results of comparison are shown in the following table.

TABLE 1

| | Present invention | Prior Art |
|---|---|---|
| Vc1 and Vc2 | Vc1 = 18 V, Vc2 = 162 V | X |
| β and γ | β = 0.9, γ = 1.0 | X |
| Inductance $L_r$(uH) | *0.98 | 0.14 (= $L^*_{REF}$) |
| Characteristic impedance $Z_n$ | 3.892 | 1.446 |
| Peak displacement current $I_{L,PK}$ | 31.2 | 62.5 |
| Peak reactive power $P_r$(W) | 33.69 | 90.97 |
| Switching loss of a sustain switch $P_s$*(W) | X | 151.26 |
| Switching loss of an auxiliary switch $P_{aux}$*(W) | X | 4.98 |

Figure 5:
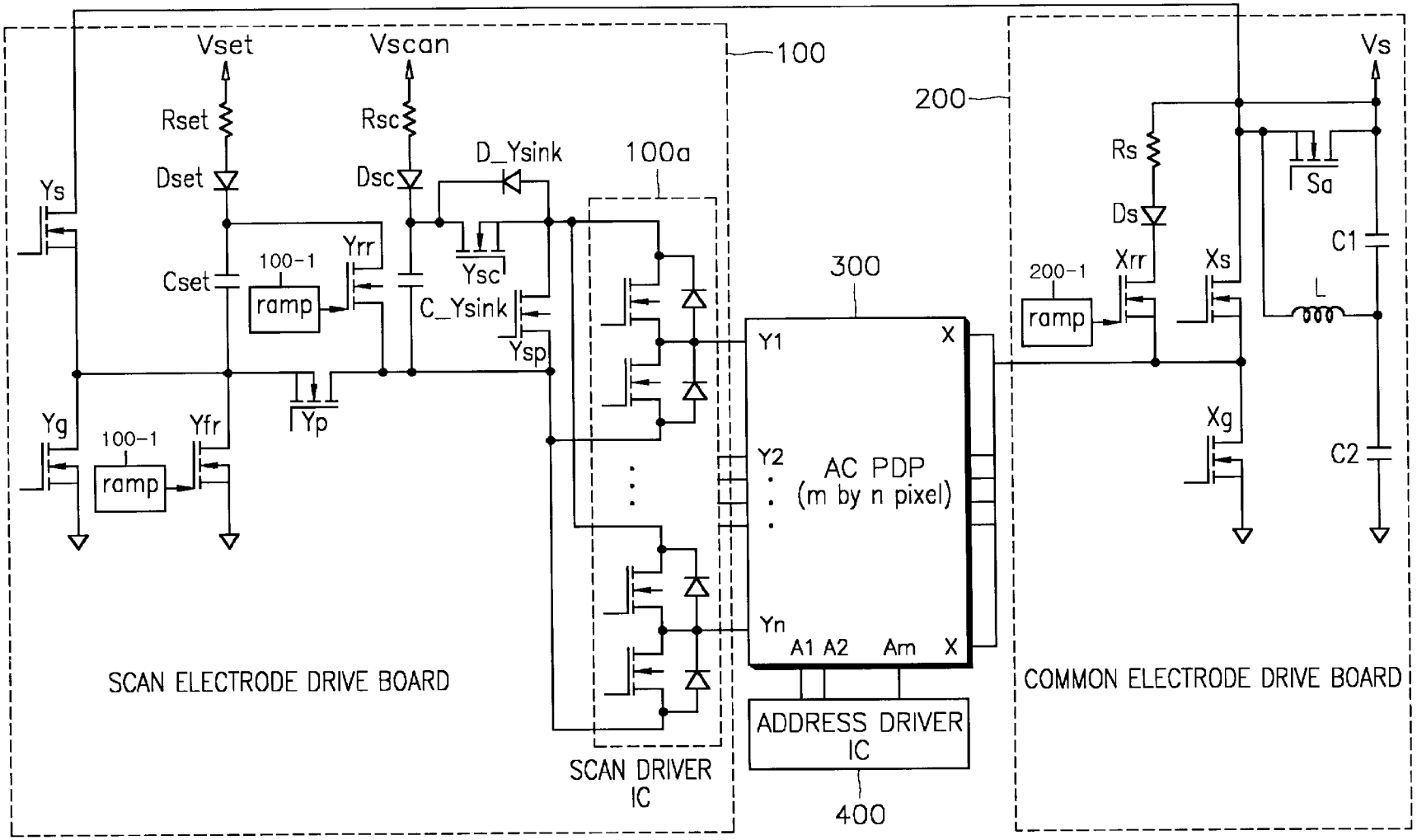
FIG. 5 is a diagram illustrating an apparatus for driving a PDP according to a second embodiment of the present invention, which is capable of increasing an energy recovery rate.

FIG. 5 is a diagram illustrating an apparatus for driving a PDP according to a second embodiment of the present invention, which is capable of improving an energy recovery rate. Referring to FIG. 5, the apparatus for driving a PDP includes a common electrode drive board 200 and a scan electrode drive board 100.

X-electrode sustain switches Xs and Xg, an X-electrode ramp waveform generator consisting of Xrr, Ds, Rs, and a ramp signal generator 200-1, and an energy recovery circuit consisting of L, Sa, C1, and C2 are installed on the common electrode drive board 200. Y-electrode sustain switches Ys and Yg, a Y-electrode ramp waveform generator consisting of Yfr, Yrr, Cset, Dset, Rset, and a ramp signal generator 100-1, a separation circuit Yp, and a scan pulse generator consisting of 100*a,* Ysc, Ysp, D_Ysink, Rsc, Dsc, and C_Ysink are installed on the scan electrode drive board 100.

The common electrode drive board 200 and the scan electrode drive board 100 are connected to X-electrode terminals and Y-electrode terminals, respectively, of a PDP 300. An address driver integrated circuit (IC) 400 is connected to address terminals of the PDP 300.

The operations and switching sequence of the apparatus for driving a PDP are the same as those of the apparatus for driving a PDP shown in FIG. 3, except that an energy recovery circuit, which is installed in a Y-electrode drive circuit block in the first embodiment shown in FIG. 3, is installed in an X-electrode drive circuit block in the second embodiment shown in FIG. 5, and thus their description will be omitted.

In other words, in the second embodiment shown in FIG. 5, the structure and switching sequence of the apparatus for driving a PDP are designed such that the time taken to increase the current of the inductor L of the energy recovery circuit when charging/discharging the PDP 300 can be minimized by following the method described with reference to FIG. 3. Thus, the apparatus for driving a PDP of the second embodiment of the present invention is capable of maintaining displacement power at about 0. In order to maintain the displacement power at 0, the apparatus for driving a PDP is designed such that the maximum instantaneous current of the inductor L flows into the PDP 300 at a transition time between charging of the PDP 300 and discharging of the PDP 300.

As described above, according to the present invention, it is possible to improve displacement power by designing the structure and switching sequence of an apparatus for driving a PDP such that the time taken to increase the current of an inductor when charging/discharging a PDP can be minimized. In addition, it is possible to prevent switching loss from being generated and decrease EMI. Moreover, it is possible to decrease the number of circuit to be less than the number of circuit devices required in a conventional PDP driver.

The present invention can be embodied into various forms including a method, a device, and a system. When applying the present invention to software, the elements of the present invention correspond to code segments. Programs or code segments can be stored in a processor readable medium or can be transmitted by computer data signals coupled with a carrier in a transmission medium or communication network. The processor readable medium includes all kinds of media, which can store or transmit data, such as electronic circuits, semiconductor memory devices, ROMs, flash memories, $E^2$PROMs, floppy disks, optical disks, hard disks, optical fiber media, and radio frequency (RF) network. The computer data signals include all signals, which can be transmitted through a transmission medium, such as an electronic network channel, optical fibers, atmosphere, an electron field, and an RF network.

While this invention has been particularly shown and described with reference to preferred embodiments thereof, it will be understood by those skilled in the art that various changes in form and details may be made therein without departing from the spirit and scope of the invention as defined by the appended claims.

What is claimed is:

1. An apparatus for driving a plasma panel display (PDP), which is capable of improving an energy recovery rate, the apparatus for driving a PDP comprising:

an energy recovery circuit; and a plurality of first switches, wherein the energy recovery circuit comprises a second switch for applying a power source during a gas discharging period of the PDP;

capacitors connected in series between the power source and ground;

an inductor connected between a point in a path connecting the two capacitors and an output terminal of the second switch; and means for setting a switching sequence for controlling turning on/off of the second switch and the plurality of first switches so that the maximum instantaneous current of the inductor flows into the PDP at a transition time between charging of the PDP and discharging of the PDP.

2. The apparatus for driving a PDP of claim 1, wherein the switching sequence is designed so that zero-voltage switching is performed.

3. The apparatus for driving a PDP of claim 1 further comprising diodes which are connected to the two capacitors respectively, in parallel.

4. The apparatus for driving a PDP of claim 1, wherein the switching sequence is designed so that voltage applied between the point in the path connecting the two capacitors and the ground during a sustain period is almost the same as voltage of the power source and a time interval of a ground mode is shorter than a time interval of a gas discharging mode.

5. The apparatus for driving a PDP of claim 1, wherein the switching sequence repeatedly performs a reset period, an address period, and a sustain period, in the sustain period, a Y-electrode panel charging mode, a Y-electrode panel gas discharging mode, a Y-electrode panel discharging mode, a zero-voltage maintenance mode, an X-electrode panel charging mode, an X-electrode gas discharging mode, an X-electrode panel discharging mode, and the zero-voltage maintenance mode are repeatedly performed by as many times as the number of sub fields, and a transition period between the zero-voltage maintenance mode and the reset period is designed to be shorter than a time interval of the zero-voltage maintenance mode.

6. The apparatus for driving a PDP of claim 5, wherein the current $I_L$ of the inductor L in a transition period between the zero-voltage maintenance mode of the sustain period and the reset period can be expressed by the following equation:

$$I_L(t) = Vc1\sqrt{\frac{C_1}{L}} \times \sin\frac{t}{\sqrt{LC_1}}$$

and the value of the capacitor C1 is determined so that the inductor current $I_L$ can be no greater than the maximum instantaneous current of the inductor during the sustain period.

7. The apparatus for driving a PDP of claim 5, wherein the time (T) for the inductor current $I_L$ to increase from 0 to the maximum instantaneous current of the inductor in the zero-voltage maintenance mode of the sustain period can be expressed by the following equation;

$$T = \sqrt{LC_2}\,\sin^{-1}\left(\frac{C_p}{T_r} \times \sqrt{\frac{L}{C_2}}\right)$$

where $C_p$ represents the capacitance of the PDP.

8. A method for driving a PDP, which comprises an energy recovery circuit including an inductor and has a sequence of repeatedly performing a reset period, an address period, and a sustain period, the method comprising controlling the sequence of switching operations so that the maximum instantaneous current of the inductor can flow into the PDP at a transition time between charging of the PDP and discharging of the PDP during the sustain period.

9. The method of claim 8, wherein the time for switches of a driver for the PDP to be switched is controlled so that zero-voltage switching can be performed during the sustain period.

10. An apparatus for driving a PDP, which exhibits a switching sequence of repeatedly performing a reset period, an address period, and a sustain period, the apparatus for driving a PDP comprising:

a Y-electrode sustain switching circuit for applying high-frequency square waves to a Y-electrode of the PDP during the sustain period;

a separation circuit for separating the operations of the sustain period, the address period, and the reset period from one another;

a Y-electrode ramp waveform generator for applying ramp-type high voltage to the Y-electrode of the PDP during the reset period;

a scan pulse generator for applying a horizontal synchronization signal during the address period, the scan pulse generator being short-circuited during the reset period and the sustain period;

an X-electrode sustain switching circuit for applying high-frequency square-wave voltage to an X-electrode of the PDP during the sustain period;

an X-electrode ramp waveform generator for applying ramp type high voltage to the X-electrode of the PDP during the reset period; and an energy recovery circuit including an inductor for recovering power when charging/discharging the PDP in the sustain period, wherein the switching sequence is controlled so that the maximum instantaneous current of the inductor of the energy recovery circuit flows into the PDP at a transition time between charging of the PDP and discharging of the PDP in the sustain period.

11. The apparatus for driving a PDP of claim 10, wherein the Y-electrode sustain switching circuit, the separation circuit, the Y-electrode ramp waveform generator, and the scan pulse generator are installed on a scan electrode drive board, and the X-electrode sustain switching circuit, the X-electrode ramp waveform generator, and the energy recovery circuit are installed on a common electrode drive board, and the scan electrode drive board and the common electrode drive board are connected to Y electrode terminals and X electrode terminals, respectively, of the PDP.

12. The apparatus for driving a PDP of claim 10, wherein the energy recovery circuit comprises:

a switch for applying a power source during the gas discharging period of the PDP;

two capacitors connected between the power source and ground in series; and an inductor connected between a point in the path connecting the two capacitors and an output terminal of the switch, wherein the switching sequence is controlled so that the maximum instantaneous current of the inductor flows into the PDP at a transition time between charging of the PDP and discharging of the PDP in the sustain period.

13. The apparatus for driving a PDP of claim 10, wherein the switching sequence is designed so that the switches included in the apparatus for driving a PDP can perform zero-voltage switching.

14. The apparatus for driving a PDP of claim 12, wherein the switching sequence is designed so that voltage applied between the point in the path connecting the two capacitors and the ground during the sustain period is almost the same as the voltage of the power source and the time interval of a sustain ground mode is shorter than a sustain gas discharging mode.

15. The apparatus for driving a PDP of claim 10, wherein, in the sustain period, a Y-electrode panel charging mode, a Y-electrode panel gas discharging mode, a Y-electrode panel discharging mode, a zero-voltage maintenance mode, an X-electrode panel charging mode, an X-electrode panel discharging mode, and the zero-voltage maintenance mode are repeatedly performed by as many times as the number of sub fields, and a transition period between the zero-voltage maintenance mode and the reset period is designed to be shorter than a time interval of the zero-voltage maintenance mode.

16. The apparatus for driving a PDP of claim 15, wherein the current $I_L$ of the inductor L in the transition period between the zero-voltage maintenance mode of the sustain period and the reset period can be expressed by the following equation:

$$I_L(t) = Vc1\sqrt{\frac{C_1}{L}} \times \sin\frac{t}{\sqrt{LC_1}}$$

and the value of the capacitor C1 is determined so that the inductor current $I_L$ can be no greater than the maximum instantaneous current of the inductor during the sustain period.

17. The apparatus for driving a PDP of claim 15, wherein the time (T) for the inductor current $I_L$ to increase from 0 to the maximum instantaneous current of the inductor in the zero-voltage maintenance mode of the sustain period can be expressed by the following equation;

$$T = \sqrt{LC_2}\sin^{-1}\left(\frac{C_p}{T_r} \times \sqrt{\frac{L}{C_2}}\right)$$

where Cp represents the capacitance of the PDP.

* * * * *